United States Patent [19]

Prines

[11] Patent Number: 4,546,952

[45] Date of Patent: Oct. 15, 1985

[54] INGOT MOLD WITH HOT TOP BOARD ASSEMBLY

[75] Inventor: Frederick W. Prines, Latrobe, Pa.

[73] Assignee: Metallurgical Exoproducts Corporation, McKees Rocks, Pa.

[21] Appl. No.: 575,894

[22] Filed: Feb. 1, 1984

[51] Int. Cl.[4] ..... B22D 7/10

[52] U.S. Cl. ..... 249/106; 249/197; 249/201; 249/202

[58] Field of Search ..... 164/359; 249/106, 197–202, 249/DIG. 5

[56] References Cited

U.S. PATENT DOCUMENTS

| | | | |
|---|---|---|---|
| 1,893,207 | 1/1933 | Messler et al. | 249/201 |
| 1,921,729 | 8/1933 | Charman | 249/201 |
| 2,231,813 | 2/1941 | McDonald | 249/201 |
| 2,301,101 | 11/1942 | Welshans | 249/62 |
| 3,421,731 | 1/1969 | Koch et al. | 249/197 |
| 3,722,848 | 3/1973 | Young | 249/197 |
| 3,972,502 | 8/1976 | Korhel | 249/202 X |

FOREIGN PATENT DOCUMENTS

| | | | |
|---|---|---|---|
| 2165756 | 8/1973 | France | 249/197 |
| 55-50956 | 4/1980 | Japan | 249/197 |

*Primary Examiner*—Nicholas P. Godici
*Assistant Examiner*—J. Reed Batten, Jr.
*Attorney, Agent, or Firm*—Webb, Burden, Robinson & Webb

[57] ABSTRACT

A disposable hot top board includes a compressible seal positioned along the outer surface of the board to form a seal between the bottom of the board and the mold wall. In a preferred form, the disposable hot top board comprises an insulating or exothermic material having a reticulated metal mesh embedded therein. A metal plate extends along at least a portion of the outer surface and a ceramic fiber strip extends along a bottom portion of the board. A perforated metal retention strip with a first end interwoven with the mesh and a second end extending outward from the board, is used with a big end up mold having a pair of slots. In addition to the standard internal wedge system, the board is forcibly retained against the ingot mold to compress the fiber strip into a seal by a rod which engages the metal retention strip in a wedging type relationship with the mold exterior.

5 Claims, 4 Drawing Figures

INGOT MOLD WITH HOT TOP BOARD ASSEMBLY

FIELD OF THE INVENTION

My invention relates to hot top assemblies and more particularly, to hot top boards for use in big end up slotted molds.

DESCRIPTION OF THE PRIOR ART

Hot top systems employed in teeming killed steel ingots and the like are normally of the disposable type which comprise side boards held in place within the ingot mold interior by various clips, wedges, rods or other securing means or are of the permanent type in which a refractory-lined casing is positioned atop of the ingot mold. The permanent hot top system normally includes refractory brick, but various forms of replaceable refractory linings have been used.

In order for the hot top system to be effective, it must be substantially filled with molten metal to provide an adequate reservoir of molten metal. Generally, the hot top volume varies from 10 to 15% of the total volume, depending on the particular system.

Ingot molds that are used to receive the molten metal, such as steel are tall, box-like containers made of cast iron. The mold cavity for receiving the molten steel is usually tapered from top to bottom of the mold, primarily to facilitate stripping of the ingot. The taper gives rise to the two principal types of molds, namely the big end down and the big end up types. It has generally been found that to assure complete freedom from pipe it is best to use big end up molds with hot tops.

After the ingots have solidified in the molds at the pouring platforms for periods determined by metallurgical experience, the drag of molds with their contained ingots are drawn by motive power to the strippers, which usually are special electric overhead traveling cranes. With big end down molds, the stripper lifts the mold from the ingot car while the plunger forces the ingot down against the ingot stool on the mold car. With big end up molds it is necessary to pull the ingot up and out of the mold while the mold is held against the stool and car. In order to facilitate grabbing the ingot, it is known to slot opposing walls of the mold so as to provide access to the ingot for engagement by the tong arms of the stripper.

Where slotted big end up molds are used, breakouts and leakers have occurred in the area of the slots causing decreased yields or the loss of the ingot. One such solution is a disposable hot top board which includes a metal reinforcing means as part of the board. The preferred reinforcing means is a metal backing plate extending along at least a portion of the outer surface of the board. In use with a big end up mold having a pair of slots, the metal reinforcing plate extends across the slots so as to prevent molten metal breakout in that area. While this solution represents an improvement over the conventional hot top board, occassional leakers were encountered and a need still exists for an improved hot top board and system which virtually eliminates breakouts and leakers.

SUMMARY OF THE INVENTION

My improved hot top board and assembly virtually eliminates breakouts and leakers and provides a system which is easily installable into the molds.

A disposable hot top board includes a compressible seal means positioned along the outer surface of the board to form a seal between the bottom of the board and the mold wall.

In a preferred form, the disposable hot top board comprises an insulating or exothermic material having a reticulated metal mesh embedded therein. A metal plate extends along at least a portion of the outer surface and a ceramic fiber strip extends along a bottom portion of the board. A perforated metal retention strip with a first end interwoven with said mesh and a second end extending outward from the board, is used with a big end up mold having a pair of slots. In addition to the standard internal wedge system, the board is forcibly retained against the ingot mold to compress the fiber strip into a seal by a rod which engages the metal retention strip in a wedging type relationship with the mold exterior.

DESCRIPTION OF THE PREFERRED EMBODIMENTS

Figure 1:
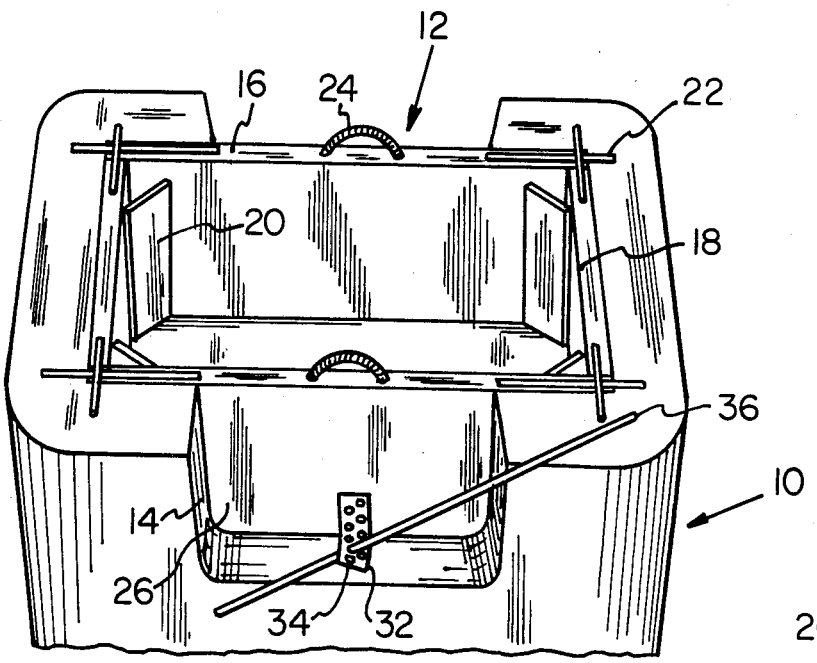
FIG. 1 is a perspective view of the upper portion of a big end up mold including my hot top assembly.

The big end up ingot mold, generally designated 10, includes my hot top assembly 12, FIG. 1. The mold 10 is a four-sided mold having slots 14 in the opposing longer walls of the mold 10. Hot top assembly 12 includes a pair of side boards 16 and a pair of end boards 18, assembled in box-like configuration. The side boards 16 and end boards 18 are held in place within the interior of the ingot mold 10 by means of wedges 20 and support rods, 22 all of which are known in the art. To facilitate handling, the side boards 16 include handles 24 which are provided along the top surface of the side boards 16.

Figure 3:
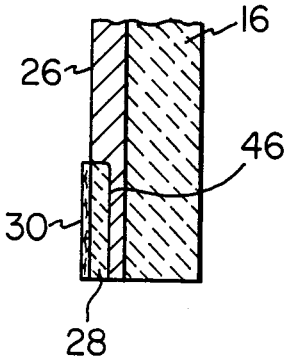
FIG. 3 is a section taken along section lines III—III of FIG. 2.
Figure 2:
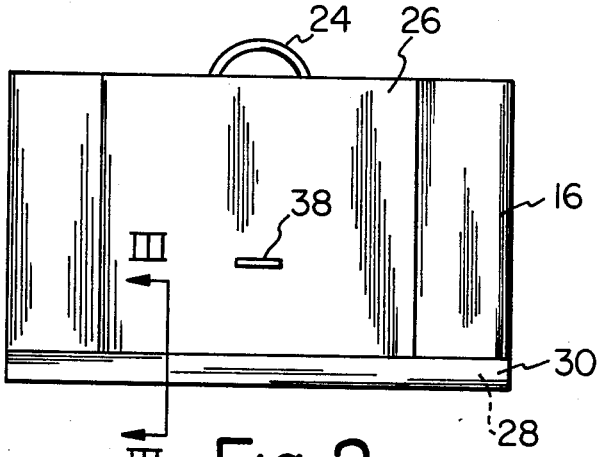
FIG. 2 is a front elevational view of the hot top board of my invention.

The external details of the side board 16 can be seen in FIGS. 2 and 3. Side board 16 is made up of an exothermic and/or insulating material which is molded into the desired hot top board size. A metal plate 26 is molded in place as a backing plate for the board to form an integral part thereof. Backing plate 26 is retained in connected relationship to the board 16 by means of plurality of projections (not shown) which connect into the thickness of the board 16. Backing plate 26 extends for a width which is greater than the width of the slot 14 of the ingot mold 10, see FIG. 1.

A ceramic fiber strip 28 extends the width of and along a bottom portion of the board 16. Ceramic fiber materials of the type known as "KaoWool" manufactured by the Babcock-Wilcox Company and "Fibrefrax" manufactured by The Carborundum Company are examples of suitable fiber materials. A thin adhesive tape 30 covers the ceramic fiber strip 28 for purposes of retaining it to the hot top board 16. Small clips 44 (FIG. 4) which extend out from the board 16 are reverse bent to also hold the ceramic fiber strip 28 to the board 16. The bottom portion of the plate 26 and/or the board 16 may include a recessed section 46 to accommodate the ceramic fiber strip 28, FIG. 3.

The purpose of the ceramic fiber strip is to form a tight seal against the interior of the mold wall and prevent metal breakout from beneath the hot top 12 as the ingot mold is being filled with molten metal. The seal is facilitated by placing the ceramic fiber strip in compression for tight engagement with the mold wall. While the wedges 20 provide some of the necessary force, it has been found that this force must be supplemented. For this purpose, a perforated retention strip 32 extends outward through slot 38 in plate 26 and normal to board 16, FIG. 1. The hot top assembly 12 is assembled within the ingot mold and held in place by the conventional wedges 20 and support rods 22. Rod 36 is then positioned through a suitable perforation 34 in the strip 32. By using a twisting action on the rod 36, it is retained across the slot 14 in wedging relationship to the exterior of the mold 10, FIG. 1. This means that a strong compressive force is applied to the ceramic fiber strip 28, thereby forming a positive seal along the bottom of the board 16 and preventing breakouts and leakers to occur.

Figure 4:
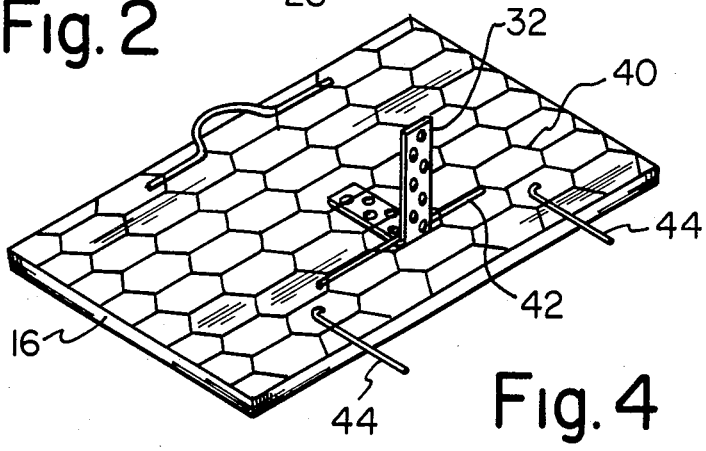
FIG. 4 is a perspective view of my hot top board during manufacture, illustrating the internal reinforcement and the attachment of the retention strip and clips.

Because of the force applied to the metal retention strip 32, the strip must be securely held within the hot top board. This is best seen in FIG. 4. Hot top board 16 is actually reinforced by means of a reticulated metal mesh 40 which is inserted between two layers of an exothermic and/or insulating material which is formed into the hot top board 16. The inner end of metal strip 32 is retained beneath and/or interwoven with the reticulated metal mesh 40 and is further retained in place by means of a metal rod 42 which is likewise retained below the reticulated metal mesh 40. It will be recognized that other mechanical expedients can be used to supply a strong compressive force to the hot board to form a seal through the ceramic fiber material, although the metal strip 32 and rod 36 have been found to perform admirably to prevent breakouts and leakers.

A series of field tests were run at a steel mill on slotted big end up molds equipped with hot top assemblies including hot top boards having metal plates with and without the compressible fiber strips. It was found that with the metal plate alone, leakers occurred some 6–8% of the time, whereas with the compressible fiber strip a small fraction of 1% of the tests resulted in any form of leaker at all.

I claim:

1. In a combination of a big end up mold having a pair of slots along opposite sides and extending downward from a top of the mold and a hot top board assembly arranged in box-like relationship and retained along an inner perimeter of a top portion of the mold, those of said boards extending across said slots having a metal plate in the area of and extending across and beyond said slots, the improvement comprising compressible seal means positioned along an outer surface of each of said boards for compressible engagement with the mold below said slots and means associated with said boards for forcibly retaining said boards against the mold interior to compress the seal means, said forcible means including a perforated metal strip extending normal from each of the said boards and through a space formed by each of said slots and a rod for engaging one of said perforations and a mold exterior adjacent each of said slots.

2. The improvement of claim 1, each of said boards including an embedded reinforcing reticulated metal mesh, an end portion of said metal strip being retained by said mesh.

3. The improvement of claim 1, said seal means comprising a ceramic fiber strip extending along the bottom width of said board.

4. The improvement of claim 3 including a layer of tape positioned atop said strip to retain it to said boards.

5. The improvement of claim 3 including clip means extending from said board to retain the fiber strip thereto.

* * * * *